US011013645B2

(12) United States Patent
Viveros Hudin et al.

(10) Patent No.: US 11,013,645 B2
(45) Date of Patent: May 25, 2021

(54) EMERGENCY STRETCHER

(71) Applicants: Vicente Fernando Viveros Hudin, Ciudad Autónoma de Buenos Aires (AR); Lucía Lavaselli, San Isidro (AR)

(72) Inventors: Vicente Fernando Viveros Hudin, Ciudad Autónoma de Buenos Aires (AR); Lucía Lavaselli, San Isidro (AR)

( * ) Notice: Subject to any disclaimer, the term of this patent is extended or adjusted under 35 U.S.C. 154(b) by 0 days.

(21) Appl. No.: 16/656,055

(22) Filed: Oct. 17, 2019

(65) Prior Publication Data

US 2021/0113395 A1 Apr. 22, 2021

(51) Int. Cl.

| | |
|---|---|
| ***A61G 1/04*** | (2006.01) |
| ***A61G 1/044*** | (2006.01) |
| ***A61G 1/048*** | (2006.01) |
| ***A61G 1/013*** | (2006.01) |

(52) U.S. Cl.
CPC ..... *A61G 1/044* (2013.01); *A61G 1/013* (2013.01); *A61G 1/048* (2013.01)

(58) Field of Classification Search
CPC ..... A61G 1/04; A61G 1/00; A61G 1/048
See application file for complete search history.

(56) References Cited

U.S. PATENT DOCUMENTS

2013/0340170 A1* 12/2013 Chinn ..... A61G 1/04 5/628

* cited by examiner

*Primary Examiner* — Fredrick C Conley
(74) *Attorney, Agent, or Firm* — Norris McLaughlin, P.A.

(57) ABSTRACT

An emergency stretcher carries a patient and comprises an upper part, for the torso and head of the patient, and a lower, for the legs of the patient, that can be adapted and configured for use in accordance to different types of injuries suffered by injured patients or those that need medical assistance such that the patient may be immobilized and carried in a much safer way.

9 Claims, 5 Drawing Sheets

EMERGENCY STRETCHER

STATE OF THE ART OF THE INVENTION

Field of the Invention

The present invention relates to the field of means, devices or arrangements used for the aid and/or rescue of persons, preferably in situations of accidents and/or in need of medical assistance, and more particularly it relates to an emergency stretcher which is constituted and constructed to provide a better hold and immobilization of the person, as well as, allows to vary the height and the angle of inclination of a part of the stretcher, more particularly in the part that holds the middle-low area of the body, according to the type of severity in which the person to be carried is.

Even when the present description refers to an emergency stretcher to be used in situations of daily accidents or in need of medical assistance, it should be clear that the stretcher of the invention can be adapted and used in any type of situation in which people or animals have to be rescued, whether in fires, landslides, environmental catastrophes, etc., or places where people are far from an assistance center or in places difficult to access, without any inconvenience.

DESCRIPTION OF THE PRIOR ART

Emergency stretchers are well known in the art wherein such stretchers allow injured person to be carried, in a safe, relatively immobilized position and protected from external agents and conditions, to the nearest medical center. It is widely known that they can comprise a rigid or semi-rigid structure provided with a plurality of fastening straps, grab means and/or transfer wheels. The stretchers can be made of tubular pipes, plastic materials, as well as cloth, etc., and are generally horizontal in length, allowing the "straight" movement of the person's body.

However, conventional emergency stretchers of the prior art, allow only to carry the person in a single horizontal position. That is, the injured person lies on the stretcher, is held by the fastening straps and is "got" into the ambulance being in a horizontal position, position in which the person will remain until reaching the medical center. This presents a great inconvenience in practice, since when the injured person has a bone fracture in the middle-lower area of the body, other types of care should be taken because immobilization in the horizontal lying position is not enough to carry the person safely or properly to the nearest medical center. In these cases, the position of the person on the stretcher varies depending on the severity of the fracture/s and it is essential to rearrange the position of the body according to the degree to avoid generating greater damage when the person is moved, this being not possible currently using conventional stretchers.

By virtue of the above, it would be convenient to have a new emergency stretcher that is constituted and constructed to be adapted to any type of accident that people may suffer in order to move them safely and properly.

SUMMARY OF THE INVENTION

It is therefore an object of the present invention to provide a new emergency stretcher that is constituted and constructed to be adapted to any type of accident that a person may suffer.

It is still another object of the present invention to provide an emergency stretcher that allows carrying the person much more safely and correctly, avoiding the generation of greater damage to the person.

It is still another object of the present invention to provide an emergency stretcher which allows a better support of the middle-lower area of the person when the person suffers from a bone fracture in that area.

It is another object of the present invention to provide an emergency stretcher that has a height-adjustable folding part that adapts to the different types of considerations to be taken into account based on the types of accidents and/or fractures that the person may suffer.

It is yet another object of the present invention to provide an emergency stretcher that provides better holding of the middle area of the body.

It is still another object of the present invention to provide an emergency stretcher of the type that has a longitudinal base structure that serves as the main support for holding and restraining people to be carried, wherein said longitudinal base structure comprises an upper part and a lower part that project in the form of a frame within which a height-adjustable folding part is provided; further providing, at least a plurality of arrangements for holding the person along said longitudinal base structure, and at least one means for securing and fixing the middle area of the body disposed on an intermediate portion between the upper part and the lower part of the longitudinal base structure; being that said height-adjustable folding part is mounted within the frame defined in the lower part through respective folding and adjustable mounting means.

BRIEF DESCRIPTION OF THE DRAWINGS

For clarity and understanding of the object of the present invention, it has been illustrated in several figures, in which the invention has been represented in one of the preferred embodiments, all by way of example, wherein.

DETAILED DESCRIPTION OF THE INVENTION

Figure 1:
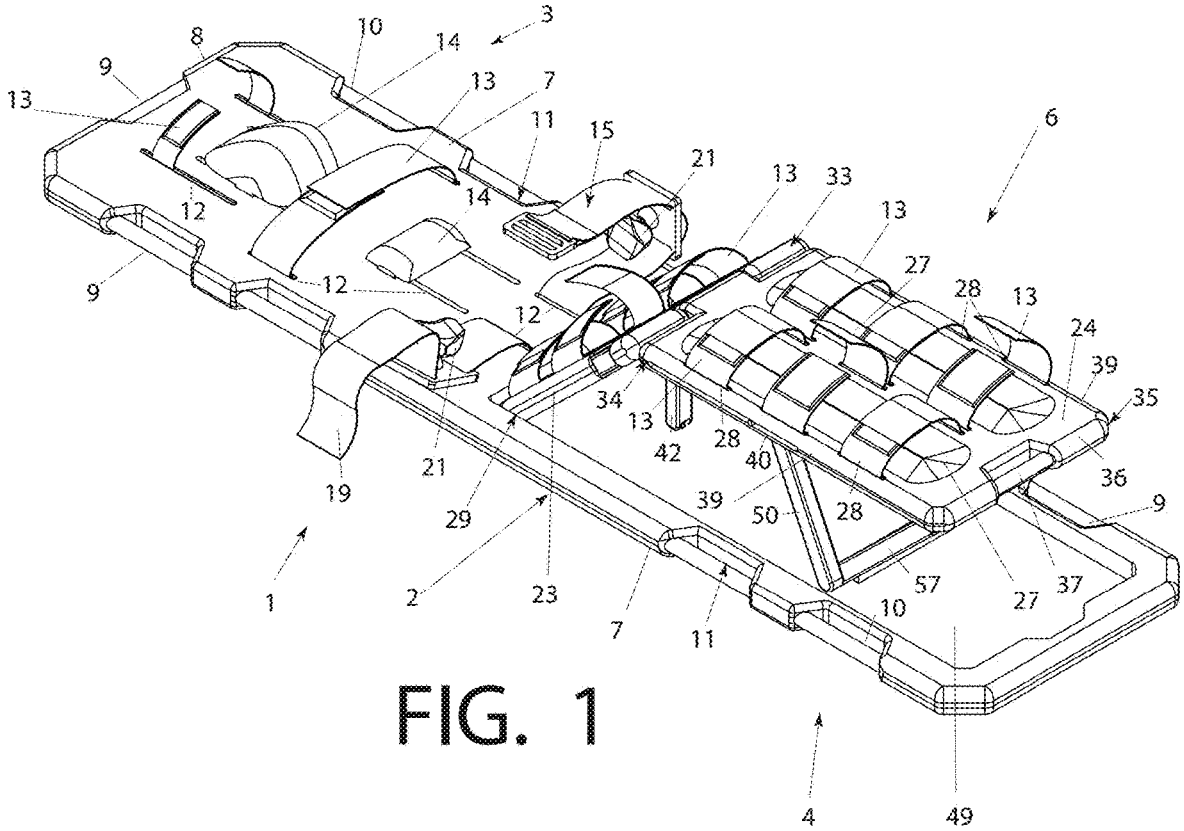
FIG. 1 shows a perspective view of the emergency stretcher according to the present invention.
Figure 2:
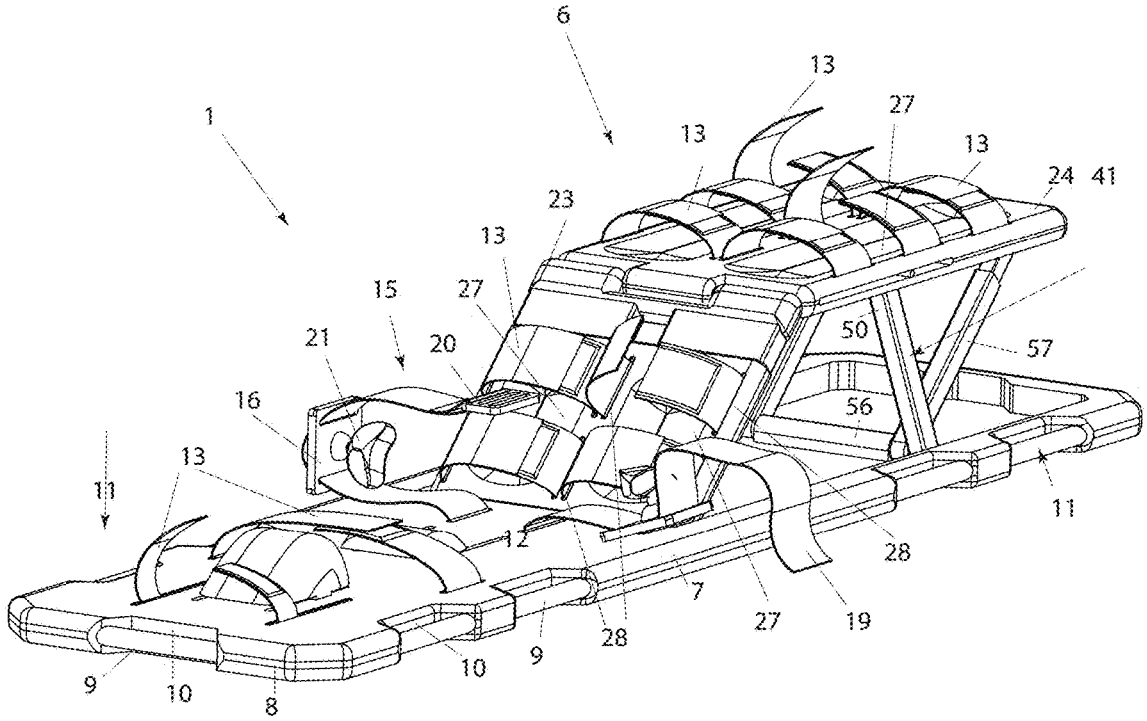
FIG. 2 shows another perspective view of the emergency stretcher of the invention, wherein a way of application thereof can be seen.

Referring now to the figures, it is seen that the invention consists of a new emergency stretcher for moving people that can be adapted and configured to be used depending on the different types of injuries suffered by the injured persons or those that may need medical assistance, immobilizing them properly and thus moving them in a much safer way. That is, a part of the stretcher of the invention can be unfolded and articulated by defining a certain angle with respect to the horizontal, so that it can thus adapt to any type of position in which the person should be moved according to the type of accident suffered.

Thus, and according to FIGS. 1 to 14, the emergency stretcher of the present invention is indicated by the general reference 1 and comprises a longitudinal base structure 2 that serves and shall serve as the main support for holding and restraining the people to be carried. Wherein, said longitudinal base structure 2 comprises an upper part or upper portion 3 and a lower part or lower portion 4 projecting in the form of a frame 5 inside which a height-adjustable folding part 6 is provided, for retaining the legs of the person or patient.

Figure 3:
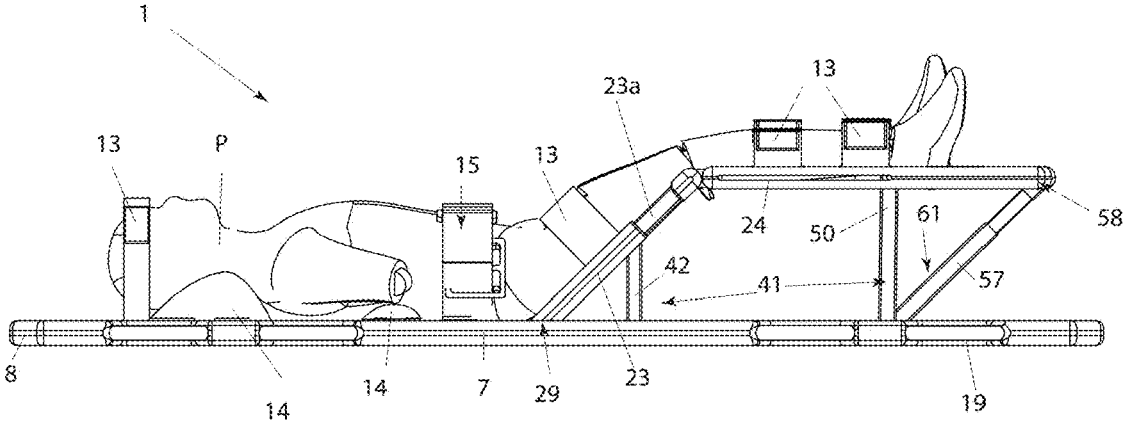
FIG. 3 shows a side view of the emergency stretcher according to the present invention, wherein a person has been illustrated therein.

Likewise, said longitudinal base structure 2 has two tubular holes lateral edges 7 and upper edge 8 on which respective grab bars 9 are mounted longitudinally, also presenting a plurality of perimeter cutouts 10, and being in the space formed between the perimeter cutouts 10 and being that in the space formed between the perimeter cutout 10 and the corresponding grab bar portion 9 respective grab zones are defined. In turn, said upper part 3 of the longitudinal base structure 2 is provided with a plurality of cutouts 12 on which a plurality arrangements for holding the torso and head of a person or patient 13 are removably mounted along said longitudinal base structure 2 and they can be fastening straps or belts with adjustable closure for both head, chest, waist, legs, and feet, which are well known in the field of art and for such reasons we will not go into descriptive details about them. In turn, said upper part may be provided with a plurality of pads 14, which may be back and neck or related pads, which are removably mounted on said cutouts 12 of the upper part 3 of the longitudinal base structure 2 such as best illustrated in FIG. 3.

In accordance with FIGS. 3 and 5 to 8, the present invention is provided with a means 15 for securing and fixing the middle area of the body, preferably the hip area of the patient, disposed in an intermediate portion between the upper part 3 and the lower part 4 of the longitudinal base structure 2. Said means 15 for securing and fixing the middle area of the body comprises a pair of side clamping plates 16, each of which has a lower slot 17 and an upper slot 18 for the passage of a fastening strap or belt 19 with adjustable closure 20 which, in turn, passes through corresponding pair of slots 12 arranged on the upper part 3 of the longitudinal base structure 2.

Figure 7:
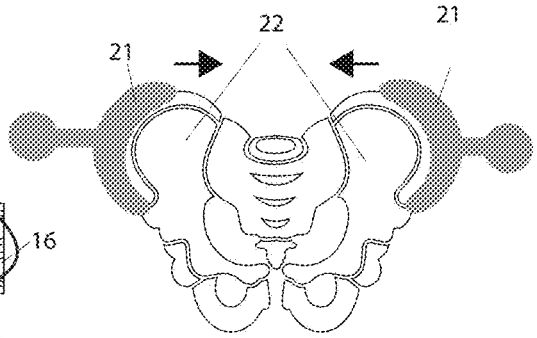
FIG. 7 shows a schematic view of the means for fixing and securing the middle area of the human body of FIG. 5, wherein a possible application is shown.
Figure 8:
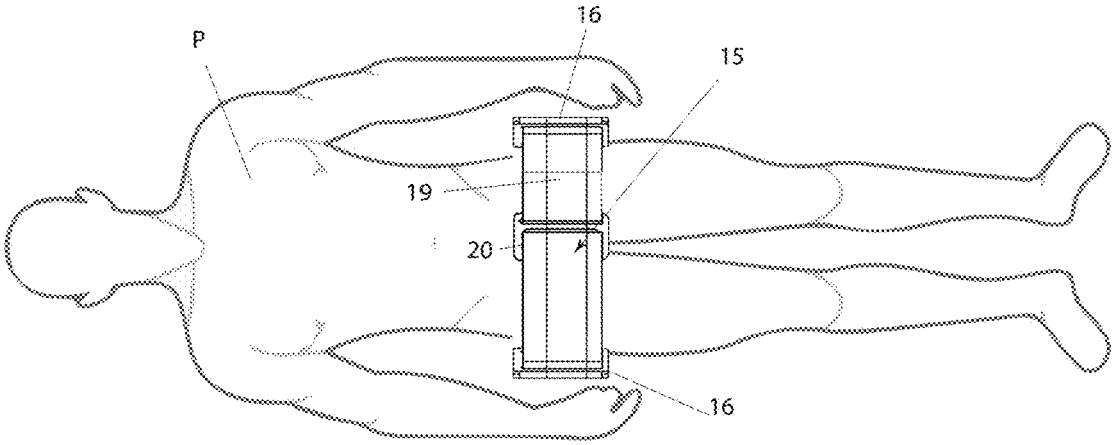
FIG. 8 shows a top view of the emergency stretcher of the present invention, wherein the means for fixing and securing the middle area holding a person on the stretcher has been illustrated.
Figure 9:
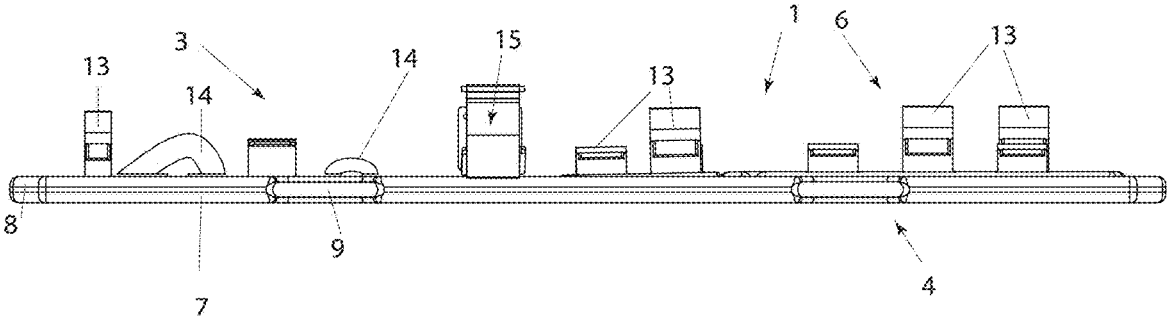
FIGS. 9 to 11 show different side views of the position of the emergency stretcher of the present invention, according to different types of application.
Figure 10:
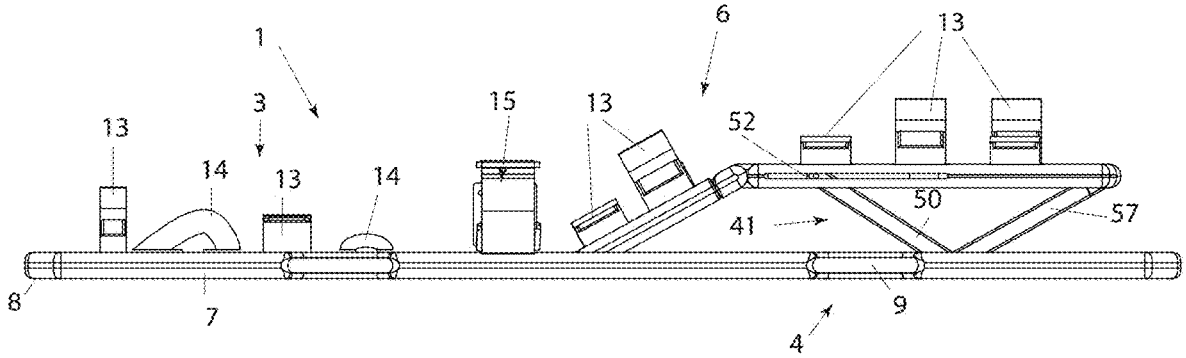
Figure 11:
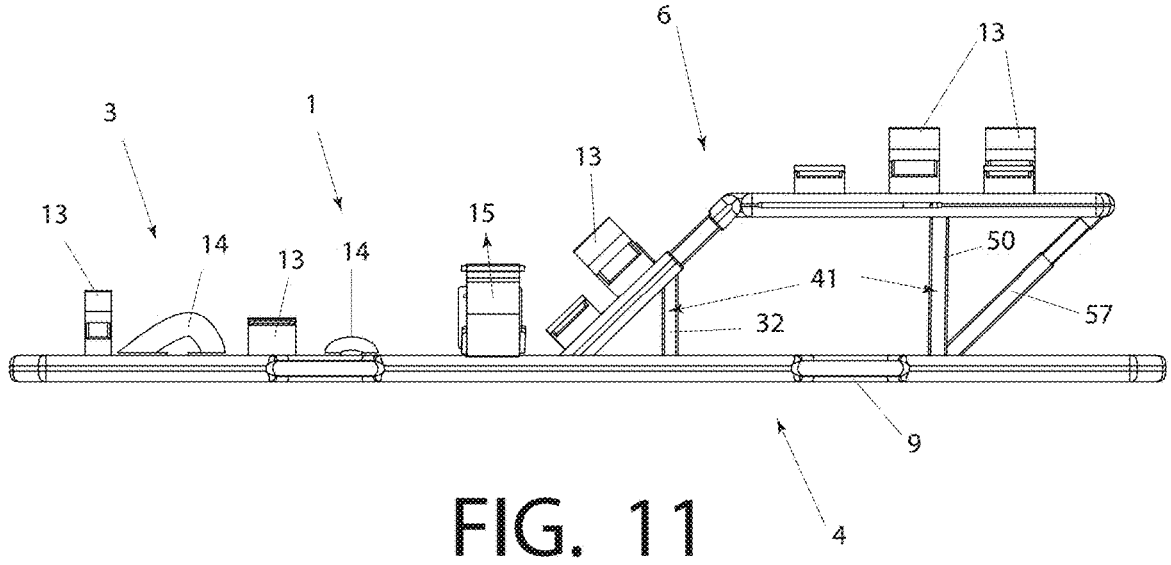
Figure 12:
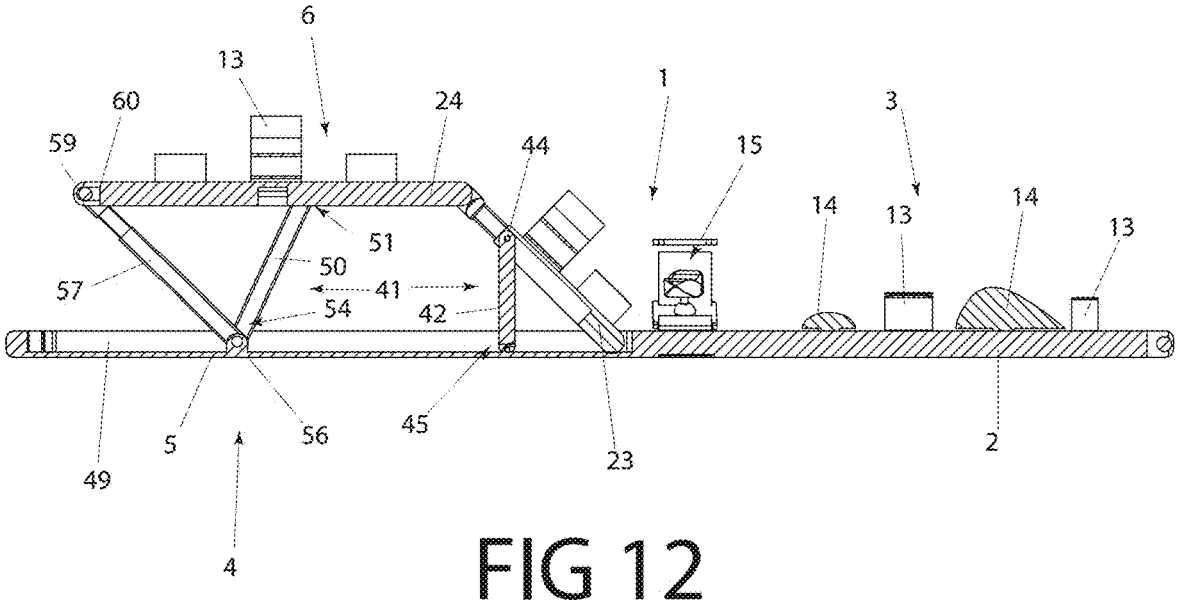
FIG. 12 shows a cross-sectional side view of the emergency stretcher of the present invention.

Likewise, each side fastening plate 16 has a tilting lateral clamping element 21 that adjusts and accommodates the external hip structure, particularly taking the pelvis, more particularly the iliac crests 22, of the person P, in order to immobilize the person correctly when suffering, for example, from diastasis or a bone fracture in said area, as schematically shown in FIG. 7. That is to say, the tilting lateral opposed clamping elements 21, are capable of tilting or pivoting in order to adapt to and taking the pelvis 22 or iliac crest, and can be accommodated by adjusting the fixing strap 19 with the adjustable closure 20 in order to correctly, securely and firmly immobilize the hip of the person if he suffered an injury, fracture or fissure in said area.

To further help with the correct immobilization of the person provided by the means for securing and fixing the middle area of the body 15, and in turn, providing the correct position of the body for carrying it when the person suffers an injury, fracture or fissure in said middle area, the present invention provides innovatively and together with the above, said height-adjustable folding part 6.

Figure 4:
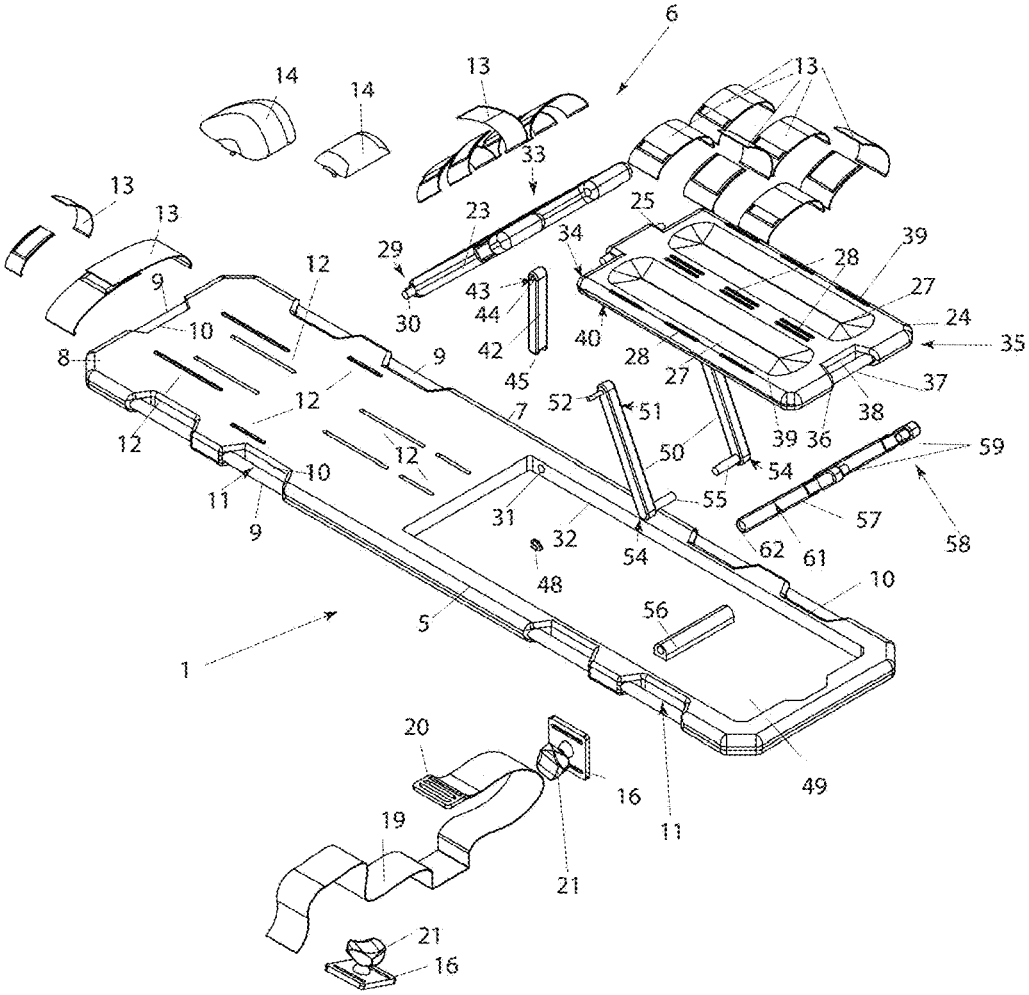
FIG. 4 shows an exploded view of the emergency stretcher according to the present invention.
Figure 5:
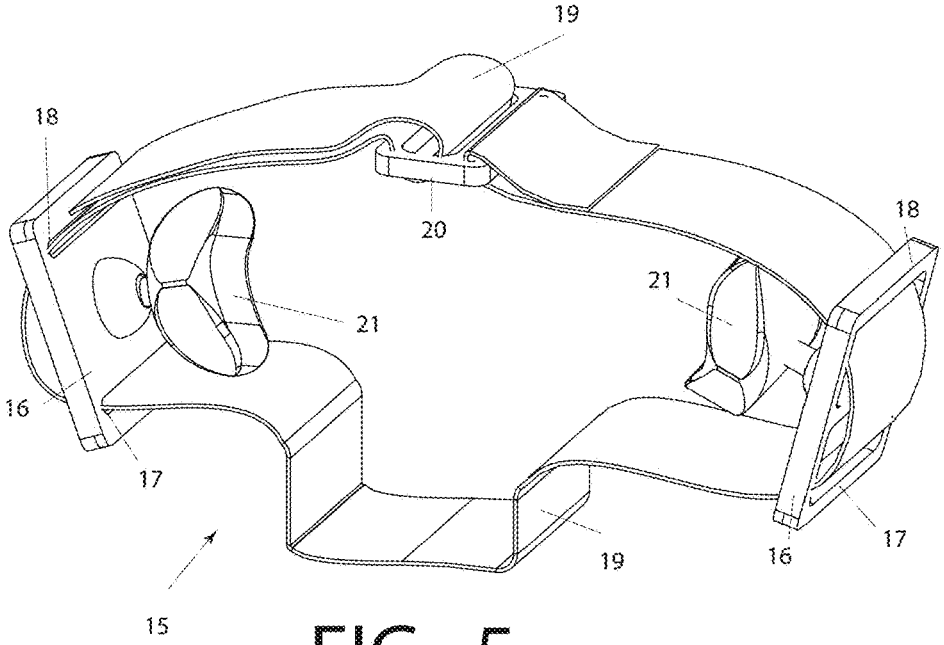
FIG. 5 shows a perspective view of a means for fixing and securing the middle area of the human body according to the present invention.
Figure 6:
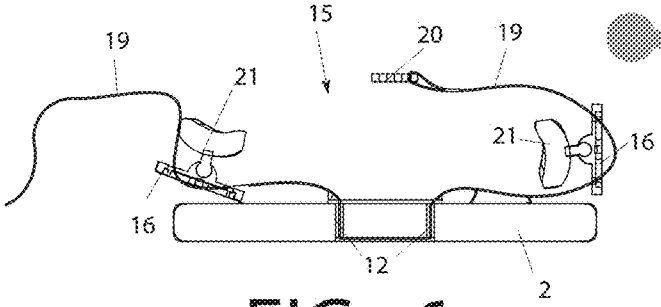
FIG. 6 shows a front view of the means for fixing and securing the middle area of FIG. 5.

Thus, FIGS. 1 to 4 and 9 to 14, said height-adjustable folding part 6 of the lower part 4 of the longitudinal base structure 2 comprises a proximal plate 23 and a distal plate 24 hingedly or pivotably interconnected through an hinge shaft 25 provided at one of the ends of said distal plate 24, which fits into a hole 26 made at one of the ends of said proximal plate 23, as best illustrated in FIG. 4. The plate 23 has an upper portion 23*a*, where the holes 26 are located, which is telescopically slidable with respect to the plate 23, whereby the plate 23 is extendable in length to maintain the angle when raising or lowering the plate 24 with respect to the base of the stretcher. This sliding portion is indicated by reference 23*a* in FIG. 4.

However, the present invention is not limited to such configuration, but other configurations can also be considered and used without any inconvenience, such as for example the inverse case in which the end of the proximal plate has the shaft and the distal plate has the hole where said shaft would fit.

Likewise, both plates 23 and 24 are provided with respective longitudinal recesses 27 that will house the legs of the person P and respective slots 28 through which said fastening for holding the persons 13 pass or are detachably mounted.

On the other hand, said proximal plate 23 has a first end 29 provided with two projecting shaft 30 that mountably fit inside respective holes 31 made in the internal face 32 of the frame 5 defined on the lower part 4 of the longitudinal base structure 2, and a second end 33 defined by the end that is in operative connection with said distal part 24 as mentioned above. While, said distal part has a first end 34 defined as the end operatively connected to said proximal part 23 as mentioned above, a second end 35 provided with a hollow tubular perimeter edge 36 on which a grab bar 37 is mounted and has a perimeter groove 38, and two side faces 39 provided with lock and unlock staggered longitudinal grooves 40.

Figure 13:
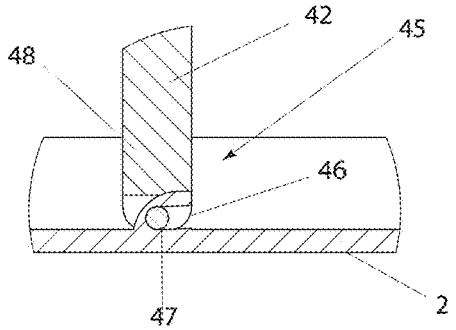
FIG. 13 shows a detailed view of a lower locking arrangement for an adjustable folding part according to the present invention.

It is emphasized that, said height-adjustable folding part 6 is mounted within the frame 5 defined on the lower part 4 through respective folding and adjustable mounting means 41. Since, said folding and adjustable mounting means comprise a first lock front arm 42 having an upper end 43 pivotally fixed through an shaft 44 on an internal portion of the proximal plate 23 and a free lower end 45 having a notch 46 with shaft 47 which operatively locks in a lock 48 arranged in an internal base platform 49 within the frame 5 as best illustrated in FIG. 13.

Likewise, said folding and adjustable mounting means have a pair of intermediate height adjustment arms 50 each having an upper end 51 provided with respective upper locking shafts 52 that selectively fit into recesses 53 defined on the lock and unlock staggered longitudinal grooves 40 of the distal part 24, and a lower end 54 having lower locking shafts 55 that pivotally fit inside a bushing 56 disposed on said internal base platform 49 within the frame 5.

In turn, said folding and adjustable mounting means 41 have a pair of rear locking arms 57 each having an upper end 58 provided with respective locking shafts 59 that slidably fit into corresponding internal slots 60 made on the hollow tubular perimeter edge 36 of the second end 35 of the distal plate 24, and a lower end 61 provided with respective holes 62 through which the lower locking shafts 55 of the intermediate height adjustment arms 50 pass. Thus, the lower part of the intermediate height adjustment arms 50 and rear locking arms 57, are connected to each other, and also remain pivotally fixed to the bushing 56, thus allowing the pivoting and/or hinge movement for folding and unfolding both arms 50 and 57 to regulate the height of the height-adjustable folding part 6.

As described above, it can be seen that the height-adjustable folding part 6 can be hingedly unfolded thanks to the fact that it comprises a proximal part 23 and a distal part 24 that are hingedly supported by the folding and adjustable mounting means 41. The proximal part 23 will serve as accommodation and support for the upper part of the legs, while the distal part 24 will act as accommodation and support for the lower part of the legs. Likewise, thanks to the arrangement of the folding and adjustable mounting means it is possible to adjust the height and angle of the height-adjustable folding part 6, more particularly to regulate the angle of tilt and height of the distal part 24.

Figure 14:
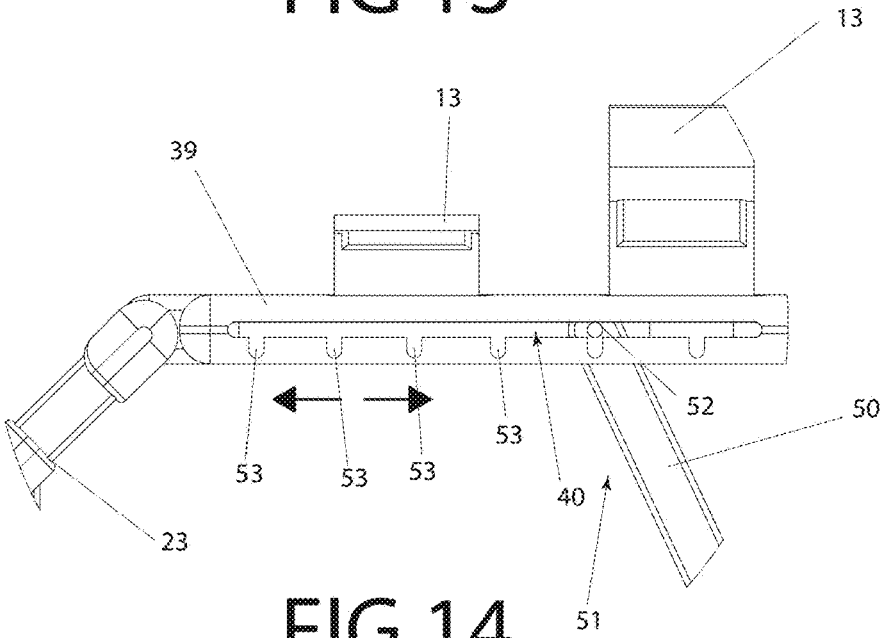
FIG. 14 shows a detailed view of an upper angle adjustment and locking arrangement for the adjustable folding part according to the present invention.

For this, the first front locking arm 42 acts as a support for locking the proximal part 23 in a fixed position thanks to the arrangement of the lock 48 that prevents unintentional sliding of the front locking arm 42. Then, by means of the intermediate height adjustment arms 50, more particularly through their locking shafts 59 in conjunction with the lock and unlock staggered longitudinal grooves 40, the angle and height are selected according to the type of severity of the fracture, fissure or injury suffered by the person, as best illustrated in FIG. 14. Accompanying the selection of height and angle of tilt, the rear locking arms allow keeping said parameters constant during the movement of the person. In conjunction with the foregoing, the arrangement of the means for securing and fixing the middle area of the body 15 allows the affected area to be correctly immobilized in order to avoid further damage to the person. In this way, the person is immobilized and carried in a much safer, adequate and correct way.

Once the stretcher of the invention is used, it can return to its normal state, that is, with the height-adjustable folding part 6 arranged in a folded way inside the frame 5, only by unlocking the front locking arm 42 of the lock 48 and unlocking the locking shafts 59 of the respective recess 14. As said respective arms 50 and 57 have lower ends 54 and 61 pivotally fixed to the bushing 56, their sliding and articulation is made easier both to unfold and fold the distal part 24.

It is emphasized that, the present emergency stretcher of the invention can be made of a material selected from the group consisting of plastics, polymers, resins, fibers, even wood and metals.

Preferably, stretcher materials will be of the type that are radiologically permeable. In this way, the patient can be sent to any healthcare and imaging center, such as X-rays, computer tomography, magnetic resonances, etc. without the need to move the patient who will remain on the stretcher properly secured and protected.

In this way, the emergency stretcher of the present invention is constituted and constructed, which allows the angle and height adjustment of proximal and distal parts 23 in order to be adapted to the different types of severity of injuries and/or fractures suffered by people, providing greater stability and also providing greater immobilization thanks to the contribution of the means for fastening and fixing the middle area of the body 15, in order to move the person in a much safer, more adequate and practical way. In turn, it is emphasized that the emergency stretcher of the present invention can also be used in any situation, terrain, climatic condition, place without any inconvenient.

We claim:

1. An emergency stretcher having a longitudinal base structure that serves as a main accommodation to hold and secure a patient to be carried, wherein:

said longitudinal base structure comprises an upper part and a lower part that projects in the form of a frame within which a height-adjustable folding part is provided;

further providing at least a plurality of arrangements for holding the patient along said longitudinal base structure, and at least one means for fixing and securing a middle area of the body of the patient disposed in an intermediate portion between said upper part and said lower part of the longitudinal base structure, said at least one means for fixing and securing the middle area of the body of the patient comprises a pair of lateral clamping plates, each of which has at least one slot for the passage of a fastening tape or belt with adjustable closure which, in turn, passes through slots of the upper part of the longitudinal base structure, wherein a tilting lateral clamping element for accommodating a hip area of the patient is provided in a respective one of the lateral clamping plates; and said height-adjustable folding part is mounted within the lower part of the longitudinal base structure through respective folding and adjustable mounting means.

2. The emergency stretcher according to claim 1, wherein said longitudinal base structure has two hollow tubular side edges and upper edge on which respective grab bars are mounted longitudinally, and have a plurality of perimeter cutouts, wherein respective grab zones are defined in the space formed between the perimeter cutout and the corresponding grab bar portion.

3. The emergency stretcher according to claim 1, wherein said upper part of the longitudinal base structure is provided with a plurality of cutouts in which said plurality of arrangements for holding the patient are removably mounted.

4. The emergency stretcher according to claim 3, wherein said plurality of arrangements for holding the patient comprises fastening straps with adjustable closure.

5. The emergency stretcher according to claim 3, further comprising a plurality of pads removably mounted on said plurality of cutouts of the upper part of the longitudinal base structure.

6. The emergency stretcher according to claim 1, wherein said proximal plate and said distal plate are hingedly interconnected through a hinge shaft, both proximal and distal plates being provided with respective longitudinal recesses and slots through which said plurality of arrangements for holding the patient pass or are detachably mounted.

7. The emergency stretcher according to claim 6, wherein said proximal plate has a first end provided with two projecting shafts that mountably fit inside respective holes made on the internal face of the frame defined on the lower part of the longitudinal base structure, and a second end that is in operative connection with said distal plate, while said distal plate has a first end operatively connected to said proximal plate, a second end provided with a hollow tubular perimeter edge on which a grab bar is mounted and having a perimeter groove, and two side faces provided with lock and unlock longitudinal staggered grooves.

8. The emergency stretcher according to claim 7, wherein said second end of the proximal plate is part of a sliding portion that allows extending the length of the proximal plate.

9. The emergency stretcher according to claim 1, wherein said height-adjustable folding portion of the lower part of the longitudinal base structure comprises a proximal plate and a distal plate, and said folding and adjustable mounting means comprise:

a first front locking arm that has a pivotally fixed upper end in an inner portion of the proximal plate and a free lower end that has notch with shaft which operatively locks in a lock arranged in an internal base platform within the frame;

a pair of intermediate height adjustment arms each having an upper end provided with respective upper locking shafts that selectively fit into recesses defined on the lock and unlock staggered longitudinal grooves of the distal plate, and a lower end having lower locking shafts that pivotally fit inside a bushing disposed on said internal base platform within the frame; and a pair of rear locking arms each having an upper end provided with respective locking shafts that slidably fit into corresponding internal slots made on the hollow tubular perimeter edge of the second end of the distal plate, and a lower end provided with respective holes through which the lower locking shafts of the intermediate height adjustment arms pass.

* * * * *